United States Patent [19]

Halloran, Jr.

[11] 4,181,264

[45] Jan. 1, 1980

[54] CENTRIFUGALLY OR STATIC CAST GRINDING ROLLS

[75] Inventor: John J. Halloran, Jr., East Granby, Conn.

[73] Assignee: Combustion Engineering, Inc., Windsor, Conn.

[21] Appl. No.: 963,668

[22] Filed: Nov. 24, 1978

[51] Int. Cl.[2] ..... B02C 15/00

[52] U.S. Cl. ..... 241/117; 403/369; 403/370

[58] Field of Search ..... 241/110, 114, 117, 121; 403/370, 374, 259, 369

[56] References Cited

U.S. PATENT DOCUMENTS

| | | | |
|---|---|---|---|
| 2,100,734 | 11/1937 | Crites | 241/121 X |
| 3,112,116 | 11/1963 | Seitz | 403/370 X |
| 3,656,785 | 4/1972 | Lothar | 403/370 |
| 3,998,563 | 12/1976 | Kloren | 403/374 X |

*Primary Examiner*—Richard B. Lazarus
*Attorney, Agent, or Firm*—Robert I. Olson

[57] ABSTRACT

Apparatus for pulverizing coal including a bowl and a cooperating roller between which members the coal is pulverized. The grinding surface of the roller is made up of a removable sleeve which is securely held on the journal bearing housing by means of wedge lock rings located at each end of the sleeve. These wedge lock rings, along with the roller, can be easily assembled, and provide positive locking of the removable sleeve onto the journal bearing housing, even if there are slight irregularities on the tapered surfaces of the sleeve.

1 Claim, 2 Drawing Figures

CENTRIFUGALLY OR STATIC CAST GRINDING ROLLS

BACKGROUND OF THE INVENTION

Many pulverizing mills today utilize a rotating bowl or table having a raised or grinding surface upon which one or a number of rolls rotate, to thus pulverize coal or other materials to a given degree of fineness. The rolls of these mills are subject to considerable wear, and thus they are usually cast of extremely hard material. Thus, as these rolls become increasingly larger in present day mills, it becomes more of a problem to grind or otherwise finish surfaces that must be mated together in order to fit a new roller onto the journal bearing housing it is secured to. Also, as these units become larger, the replacement of the rollers results in a lengthy shut-down period during which the rolls are replaced. This is costly and time-consuming.

SUMMARY OF THE INVENTION

In accordance with the invention, apparatus is provided for pulverizing coal including a bowl and a cooperating roller between which members the coal is pulverized. The roller is in the form of a removable sleeve, which is secured on the journal bearing housing by means of a pair of wedge lock rings, one of which is located at each end of the sleeve. This permits the roller to be securely fastened to the journal bearing housing, without the necessity of any grinding or other surface preparation whatsoever of the removable sleeve, which can be of as-cast material.

DESCRIPTION OF THE PREFERRED EMBODIMENT

Figure 1:
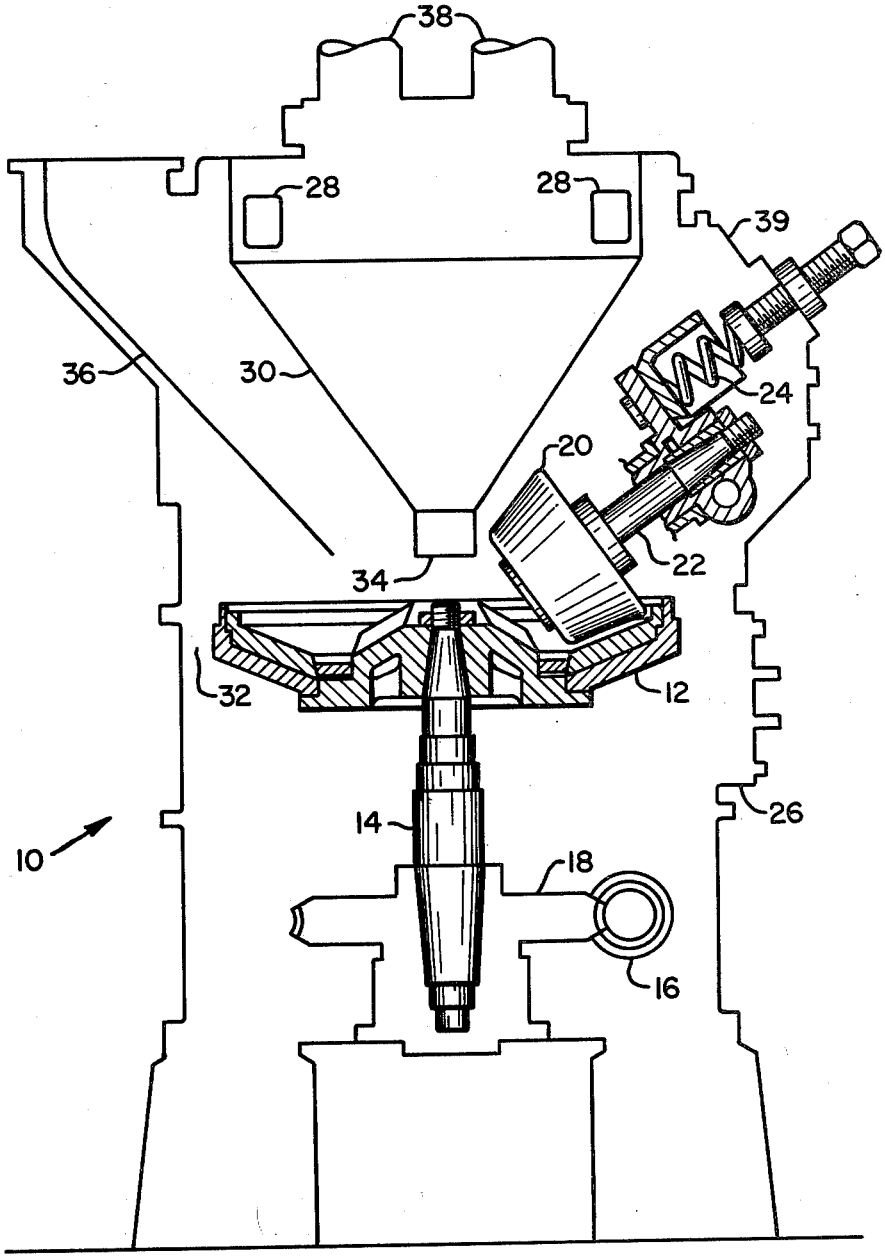
FIG. 1 is a cross-sectional side view of a bowl mill embodying the invention.

Looking now to FIG. 1, numeral 10 designates a bowl mill for grinding coal or other material therein. Inside the housing is positioned a rotatable bowl or table 12 mounted on shaft 14. Shaft 14 along with the attached bowl is rotated by means of worm wheel 18, which engages worm 16 mounted on a motor driven shaft. One or more grinding elements or rolls 20 are rotatably mounted on shaft 22. Adjustable spring 24 urges roll 20 towards the inner surface of the grinding ring.

Coal to be pulverized is introduced into the mill through inlet 36 or 34. Air enters through opening 26, and flows through annular space 32 to convey the ground material passing over the lip upwardly through the mill interior and into the classifier 30. The air and coal enter the classifier through inlets 28. The larger particles of upground coal fall back onto the grinding surface through bottom opening 34 for further grinding, and the finer particles are carried along with the air, and are discharged through outlets 38. Removable plate 39 is provided for the purpose of permitting access to the housing interior, and to enable the grinding roll assembly to be removed therefrom when replacement of the roll becomes necessary.

Figure 2:
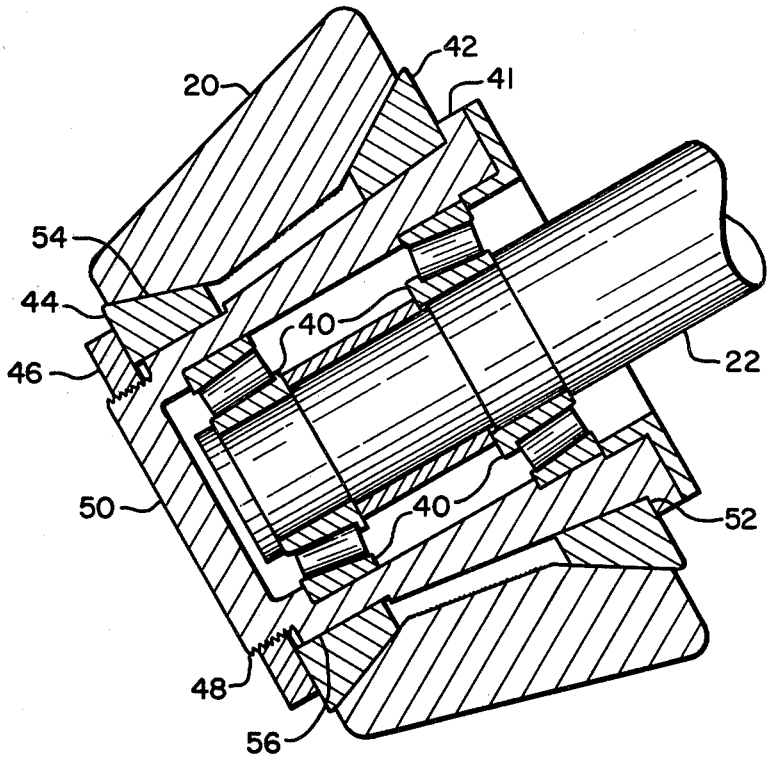
FIG. 2 is an enlarged cross-sectional view of the grinding roll shown in FIG. 1.

Looking now to FIG. 2, the manner in which the grinding rollers 20 are secured to their respective shafts 22 is shown in more detail. The grinding roll is rotatably mounted on central shaft 22. Bearings or journals 40 are mounted on the shaft so as to be immovable longitudinally therealong. Journal housing 41 surrounds the journals, and roller 20 is made fast to housing 41 by means of a pair of wedge-shaped locking rings 42 and 44. Nut 46, which coacts with the threaded portion 48 of housing 41, keeps the parts in their assembled relationship. A keyway and key member may be employed if necessary between the roller 20 and ring 42 to prevent relative movement.

If desired, inner wedge-shaped ring 42 could be made integral with the housing 41 or made fast to it through a tapered fit or key and keyway means. Also, outer ring 44 can be a split ring; i.e., made in two or more parts; or a thin, softer material may be employed between the ring and roller 20 so that it can more readily adapt to roughness or unevenness on the wedge-shaped surface of the roller 20.

The manner of assembly is as follows. The wedge-shaped locking ring is first slipped over the free end 50 of the journal housing 41 unit it seats against the end 52. The roller sleeve 20 is then slipped over the free end 50. Wedge-shaped locking ring 44 is then placed over the free end 50, and nut 46 is threaded onto threads 48, forcing ring 44 up into secure contact with the tapered portion 54 of the sleeve or roller 20. The inner surface 56 of the wedge-shaped ring 44 is cylindrical, and mates with a cylindrical surface on the housing 41. Thus, as the locking ring 44 moves to the right as shown in FIG. 2 when the nut 46 is tightened, the ring 44 is free to move until it securely contacts and locks roller 20 in place. Since the journal housing 41 and locking ring 44 are not subject to grinding action, they can be made of materials that are easily precision machined.

From the above, it can be seen that roller 20 can be secured to housing 41 and thus shaft 22, in a tight manner, even though it may be rough and contains some irregularities in the ascast state, without any machining of its surfaces. Thus, it is possible to cast the roll 20 of extremely hard material, such as "NIHARD"or "DIAMITE" which has a hardness on the order of Rockwell Hardness No. 75.

I claim

1. In a grinding mill, a grinding ring, a grinding roll which coacts with the ring to perform the grinding action, means for imparting relative rotation between the grinding ring and grinding roll, a shaft, a journal means surrounding the shaft, a housing surrounding the journal means, means for securing the grinding roll to the housing, said means including ring means at both ends of the roll which encircle the housing, the ring means being wedge-shaped in cross-section, the roll having a tapered portion at each end thereof which coacts with the wedge-shaped ring means, the shaft having a free end over which the ring means and the grinding roll can be assembled, the ring means closest to the free end of the shaft having an inner surface that is cylindrical in shape, the housing having a coacting cylindrical surface which mates with the ring means inner surface, and threadable means on the end of the housing for holding the pair of ring means and grinding roll in locked contact with each other.

* * * * *